US008186361B2

(12) United States Patent
Hampton

(10) Patent No.: US 8,186,361 B2
(45) Date of Patent: May 29, 2012

(54) WEFTLESS EXTENSIONS

(76) Inventor: Alice Hampton, New York, NY (US)

( * ) Notice: Subject to any disclaimer, the term of this patent is extended or adjusted under 35 U.S.C. 154(b) by 787 days.

(21) Appl. No.: 12/079,295

(22) Filed: Mar. 26, 2008

(65) Prior Publication Data

US 2009/0241974 A1 Oct. 1, 2009

(51) Int. Cl.
*A41G 3/00* (2006.01)

(52) U.S. Cl. ..... 132/53

(58) Field of Classification Search ..... 132/53–56, 132/201
See application file for complete search history.

(56) References Cited

U.S. PATENT DOCUMENTS 4,825,886 A * 5/1989 Allen ..... 132/54
5,853,009 A * 12/1998 Yu ..... 132/201
2001/0023699 A1* 9/2001 Matthews ..... 132/54
2004/0173233 A1* 9/2004 Tokko ..... 132/201
2009/0071492 A1* 3/2009 Oh ..... 132/201
2009/0235943 A1* 9/2009 Sugai et al. ..... 132/54
2010/0071714 A1* 3/2010 Sotokawa et al. ..... 132/201

* cited by examiner

*Primary Examiner* — Todd Manahan
*Assistant Examiner* — Brianne Kalach

(57) ABSTRACT

Partial wig components for users who do not want to wear a full wig. The invention comprises a frontal strip 2 which would mimic a new hair line for person's with a receding hair line. Additionally strips of hair may be attached on other areas of the person's head to mimic a fuller look. A natural, synthetic resinous or rubber component or base is provided for hair strips in which the frontal portion comprising a skin toned or transparent material intended to be indistinguishable from the wearer's actual skin; weaved with individual strands of hair to compose a natural looking hair line. With time the base deteriorates with use, thus a replaceable liner is adhered to the base. Thus most wear and tear will occur onto the liner. The wig is manufactured by implanting hairs or groups of hairs in elongated strips which comprise the wig base.

10 Claims, 14 Drawing Sheets

WEFTLESS EXTENSIONS

FIELD OF THE INVENTION

This invention relates to methods and apparatus for the manufacture of hair components.

BACKGROUND

It is a general aspect of the prior art that the human or synthetic hair be cut to a predetermined length and that bundles of the thusly cut hair tress be moved by hand to a double-needle sewing machine which is used to form a series of hair laces. The thread line resulting from the double-needle sewing machine is folded, to be sewed again along the previously sewed line by an ordinary one-needle sewing machine, whereafter the root of the folded part is sewed by the single-needle sewing machine to form a belt-shaped hair lace, commonly known as "weft," for the manufacture of a machine-made wig. This belt-shaped hair lace is sewed by a sewing machine onto the framed strips of a component or base, or is used in a component less wig.

In processes of the past, there are many defects. For example, many different types of specific sewing machines, enormous amounts of equipment, large numbers of persons and much time are required. The products must, furthermore pass through complicated manufacturing steps. Further, the hair will generally fall out rather easily when the wigs are combed. Moreover, the sewed lines can easily come loose. Additionally, the thickness of the hair belt is uneven because the root of the hair lace may be folded doubly or triply during the sewing in the forming of the hair belt. Still further, the direction of the hair in the wigs cannot be changed at will because thick knots which appear on the hair belt are fixed to lay in one particular direction when the hair belt is sewed onto a component or base.

Additionally the wig base will wear after consistent use. Additionally, adhesives utilized to affix hair may also deteriorate the wig base.

SUMMARY OF THE INVENTION

The type of extension likely to give a user most satisfaction is that in which the hair is transplanted as though it were actually rooted on the scalp. The appearance must be as if the hair were distributed densely and individually on the scalp. It must permit the hair style to be changed directionwise as demanded by the user's pleasure. The extension must give an impression from all views as though it was not artificial but rather that it was a natural head of hair.

Many people desire not to wear an entire wig for reasons of stigma for other aesthetic reasons. The current invention is targeted towards people who have some of their own hair but either because of the receding hair line or thinning hair may want to improve their looks. The current invention is a hair system that adds upon a persons existing hair to more naturally resemble a full head of hair.

The current invention comprises of hair strips with maybe attached strategically on a person's head to enhance their appearance. There is the frontal strip 2 which is intended to be adhered to the frontal portion of a person's scalp redefining the person's hair line. Additionally, hair strips can be clipped, sewed, weaved into said person's real hair.

In the preferred embodiment the woven net is limited to the outer edges of the hair extension component, whereas the rest is a synthetic resin or synthetic rubber structure produced through a compression or pressure process by a molding operation. This structure is a frame having no crumpling nor undesirable angles and, with it, it is possible to work out the standardizations and mass production of components or bases comprising rows of the framed strips and bridge connection forms, the spacing between the rows of strips and the bridge connection forms being readily accomplished. Human or synthetic hair is transplanted onto the rows of strips.

Generally, in achieving the various objects of the invention, namely the provision of new and improved methods of preparing supplemental hair and the products of such methods, there is contemplated the manufacture of a supplemental hair extension comprising a plurality of spaced elongated supports with hair being attached along these supports. The supplemental hair extension manufactured in accordance with the invention may comprise a base profiled as a component in conforming to at least part of the human head and including the aforesaid elongated supports with bridges connecting and extending between these supports. The supports and bridges may be connected together in a monolithic structure of flat cross-section, the supports and bridges cooperatively defining ventilation openings there between. In further accordance with the invention, at least one elastic band may be peripherally provided on an inside of the aforementioned component. In accordance with another feature of the invention, the structure may be of synthetic resin or rubber or other similar plastic.

In accordance with another embodiment of the invention, the aforementioned supports may be tubes and, in accordance with still another embodiment of the invention, the aforesaid support may be belt-plates.

In the latter embodiments, hooks may be provided detachably connecting the elongated supports to elongated elements which extend perpendicularly thereof.

According to further features of the invention, adhesive agents may connect the hair to the supports or the hair may be implanted in the supports. The implanting may be effected by means of high-frequency heating or other types of heating or the like.

In accordance with still further objects and features of the invention, there is provided a method of manufacturing a supplemental hair extension comprising molding a monolithic component of spaced strips connected by bridges of synthetic resin or rubber and connecting hair to the strips.

The above and further objects, features and advantages of the invention will be found hereinafter.

BRIEF DESCRIPTION OF THE DRAWING

Further a more detailed explanation of the invention follows below and is illustrated by the accompanying drawings in which.

DETAILED DESCRIPTION

Figure 1:
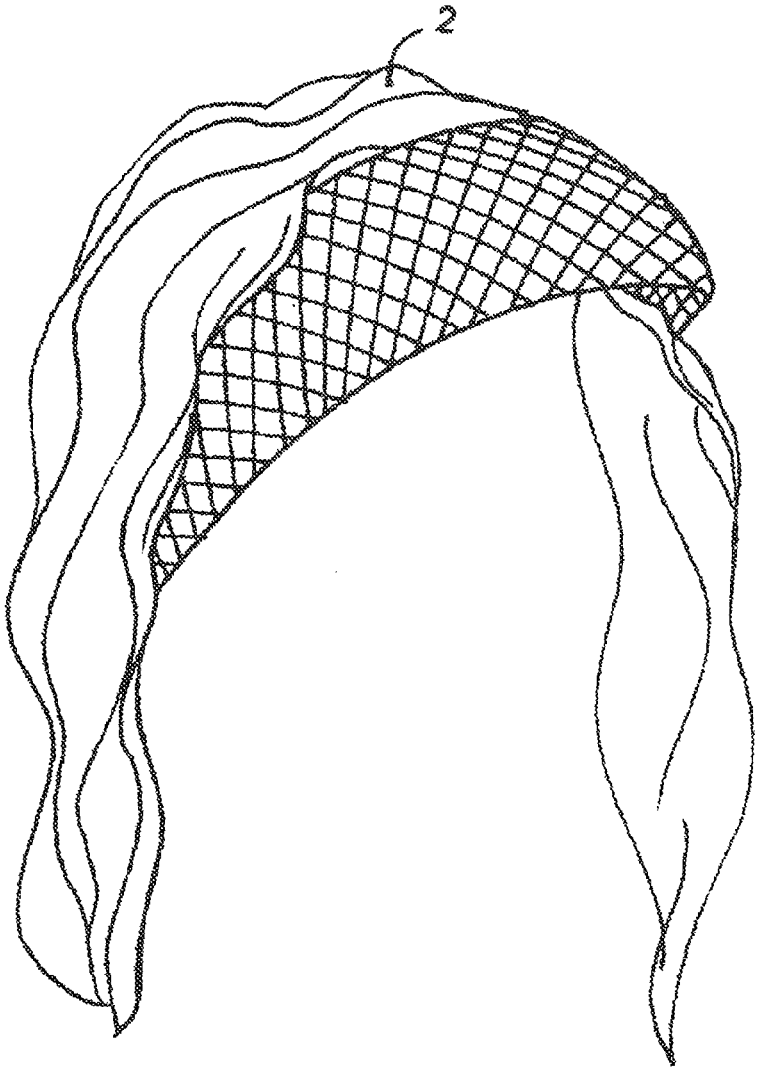
FIG. 1 front view of the frontal strip 2 intend to create a new hair line for a person with receding hairlines.
Figure 2:
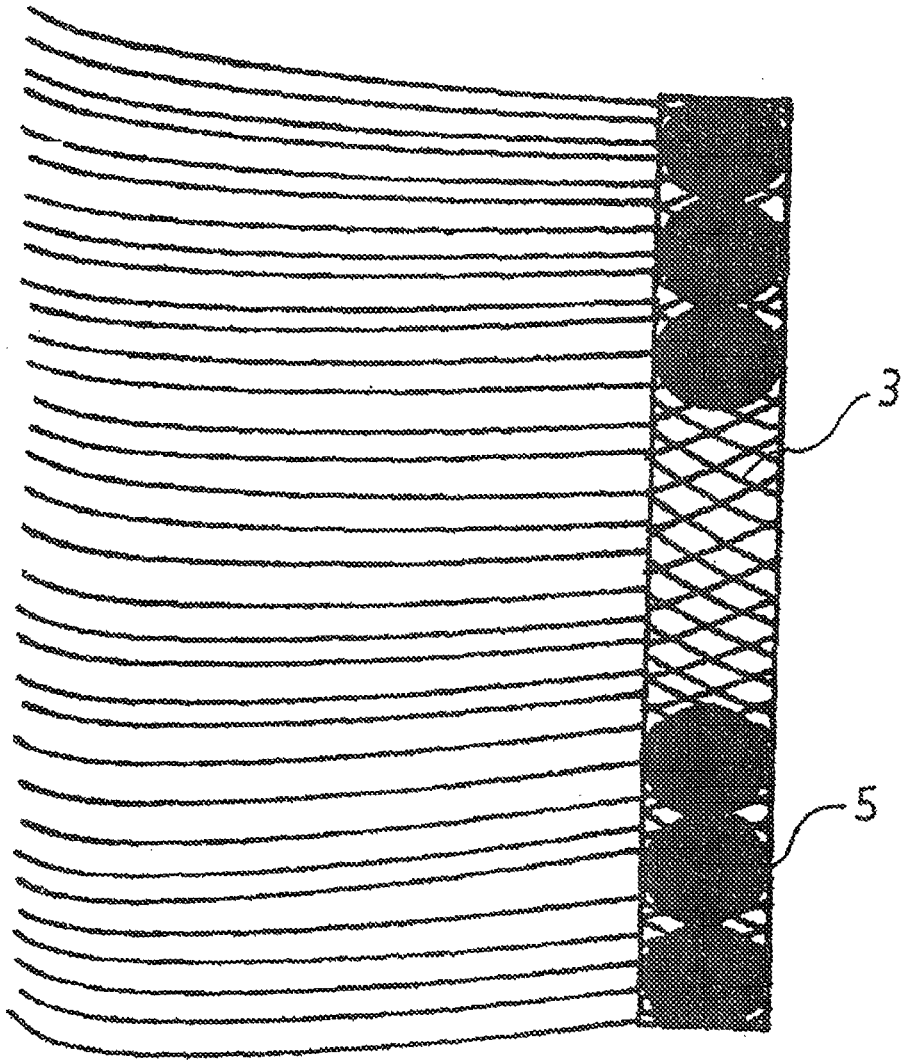
FIG. 2 top view of the hair strip intend attached to the head with a clip.
Figure 3:
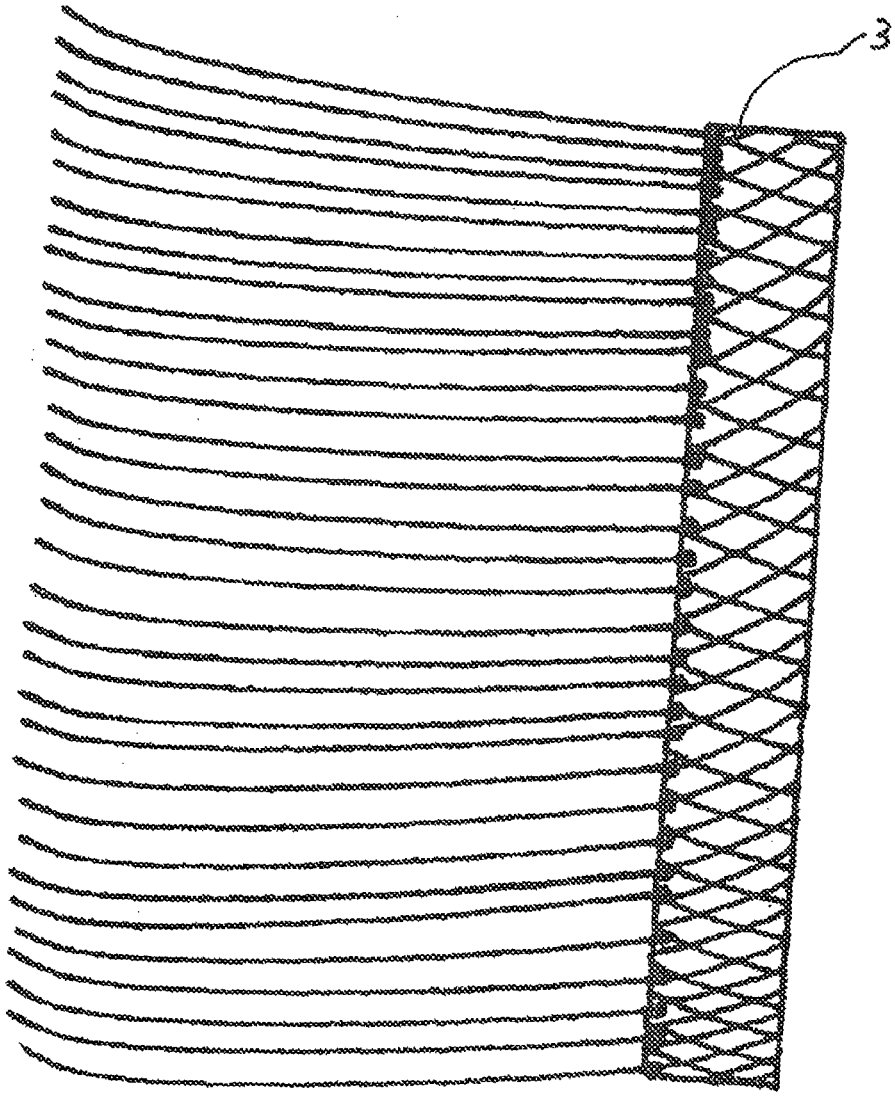
FIG. 3 top view of the hair strip intend attached to the head with adhesive.
Figure 4:
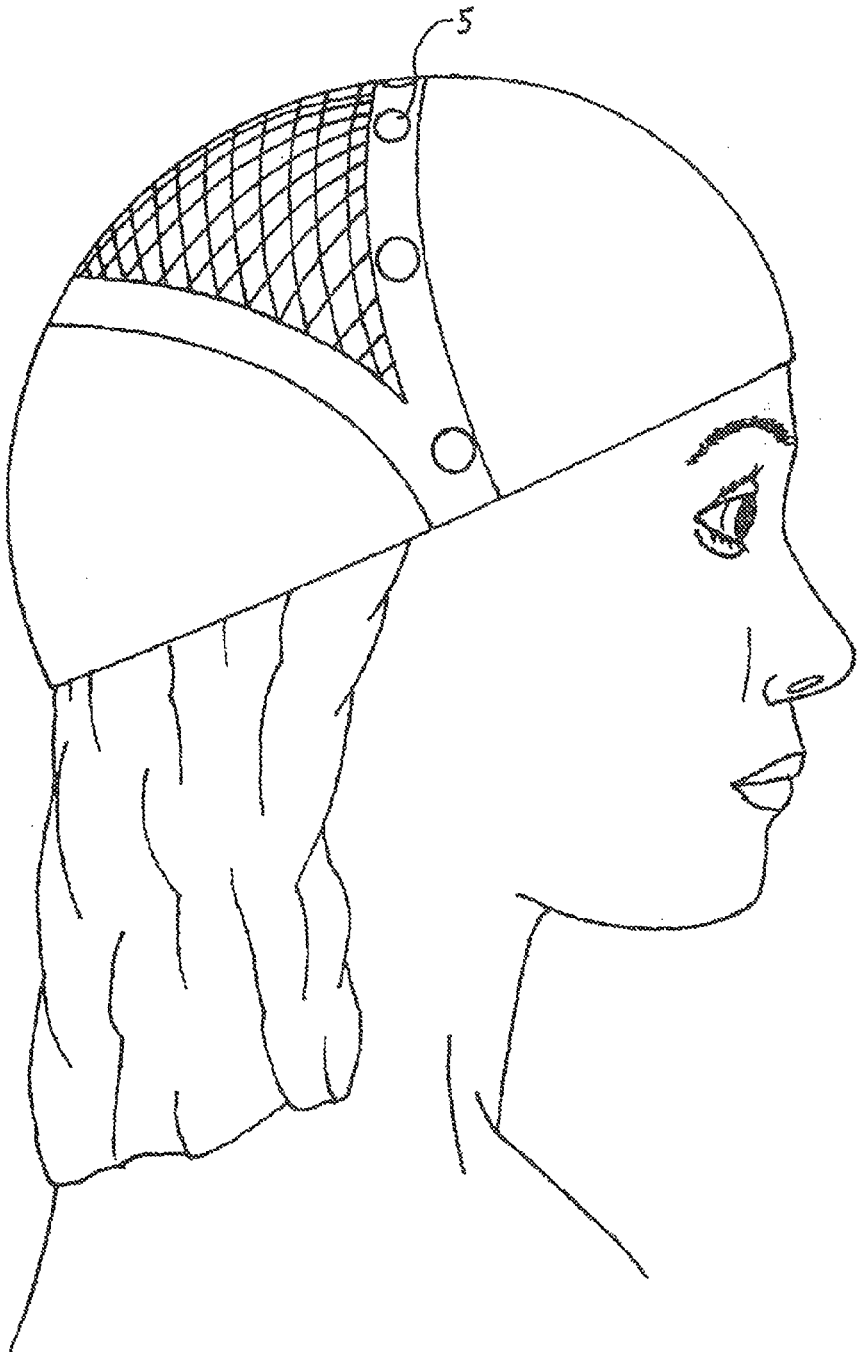
FIG. 4 is view of the underside of the supplemental hair system component as worn by the person.
Figure 5:
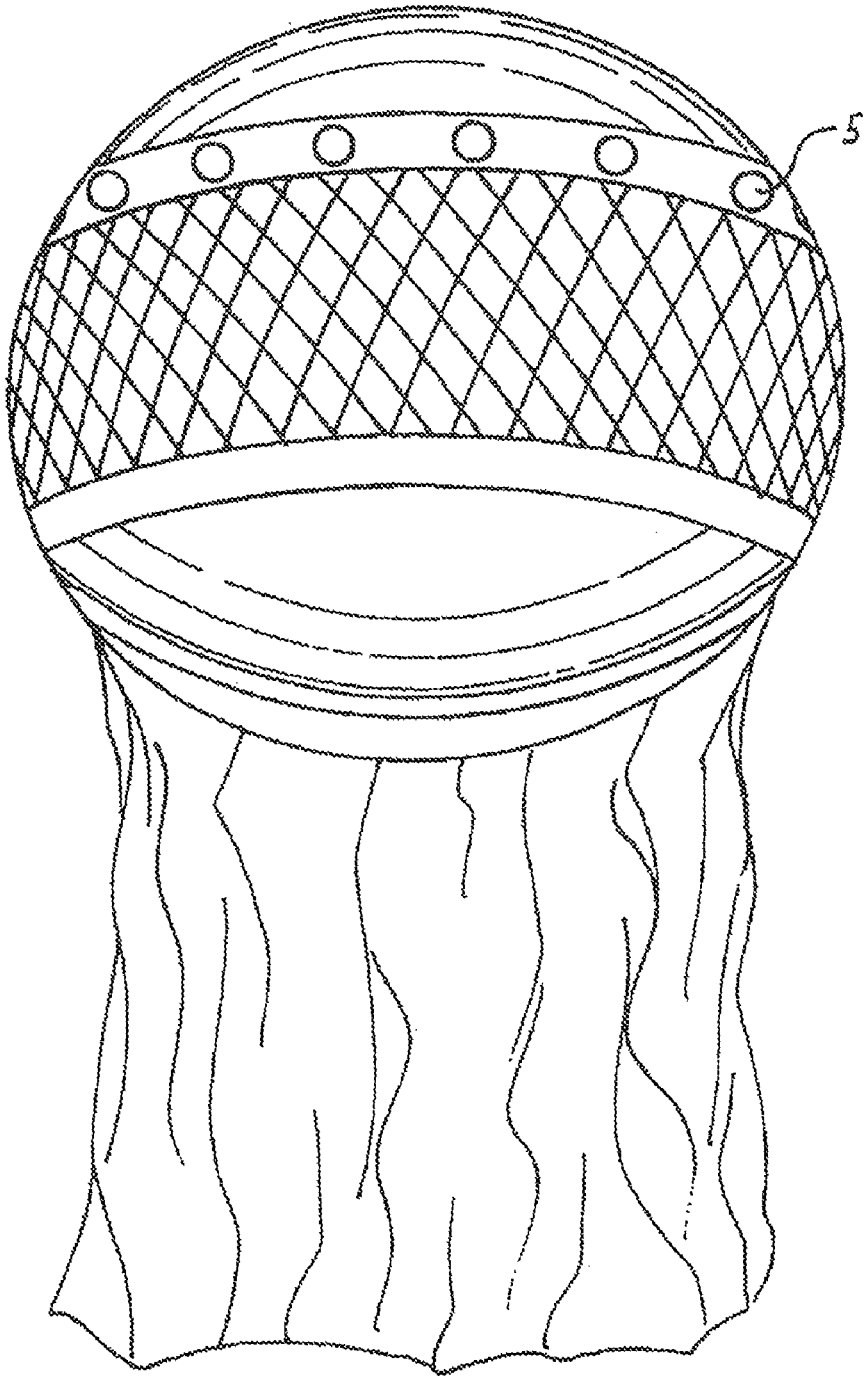
FIG. 5 is view of the underside of the supplemental hair system component with clips to attach liner.
Figure 6:
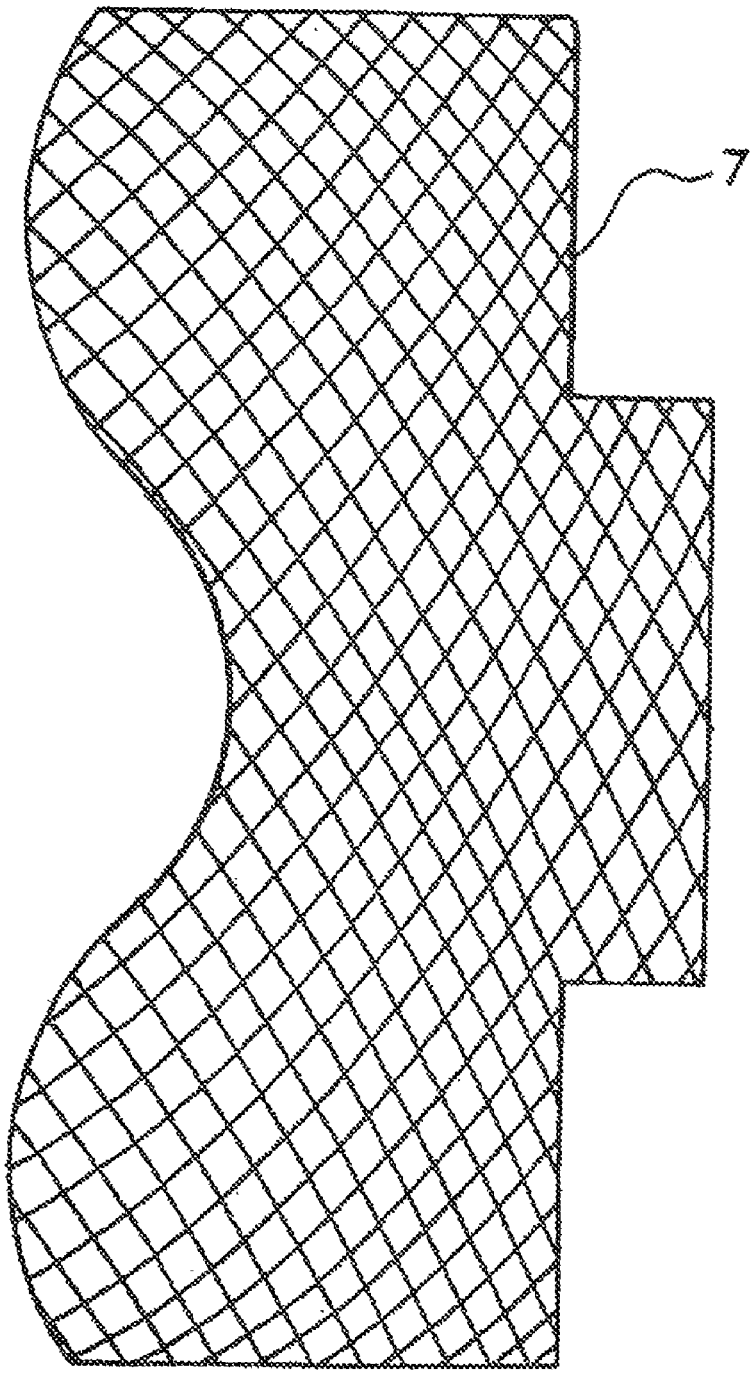
FIG. 6 is top view of supplemental hair system component liner.
Figure 7:
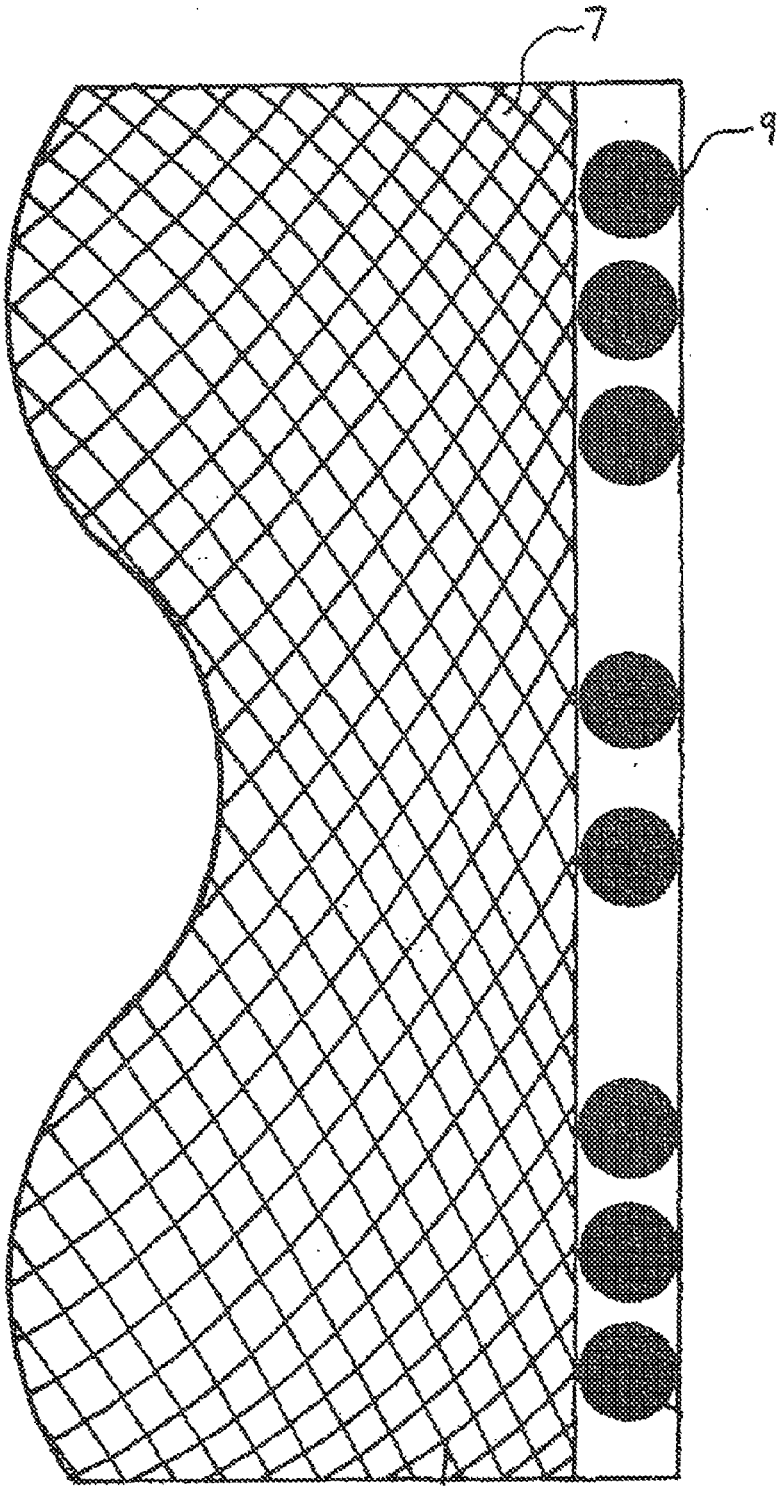
FIG. 7 is top view of supplemental hair system component liner with clips.
Figure 8:
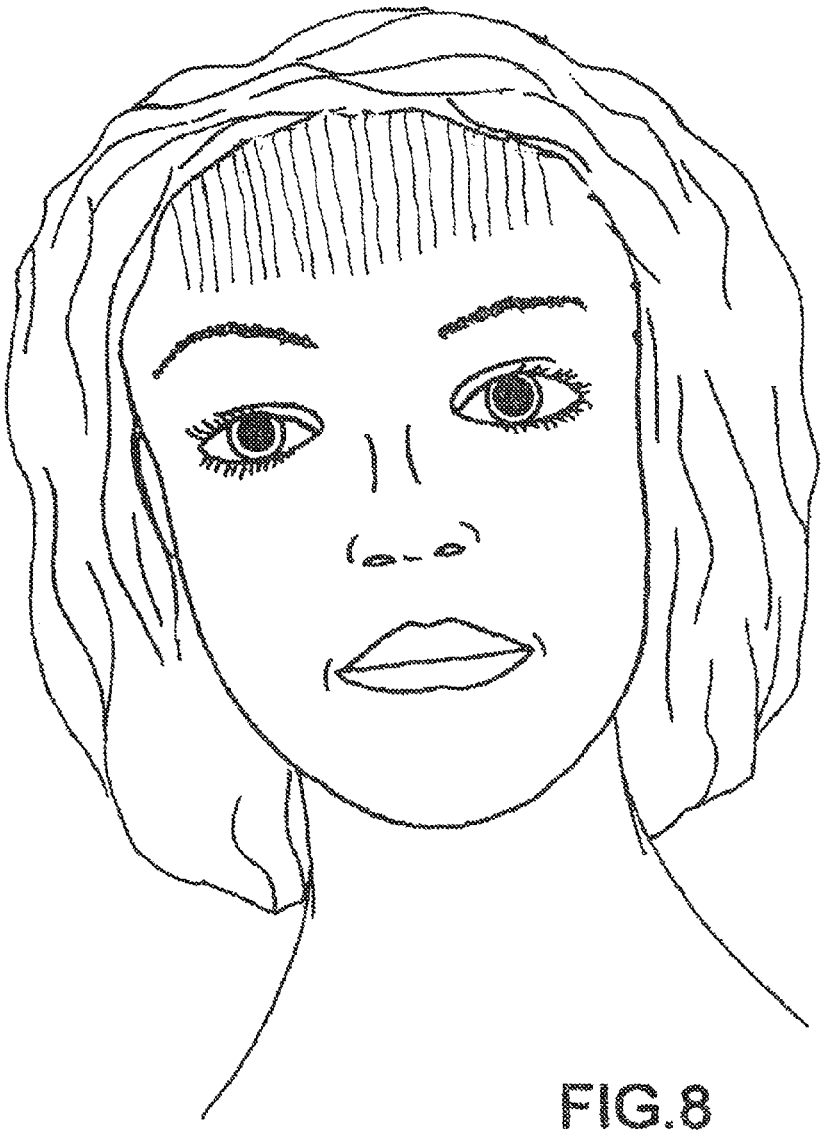
FIG. 8 is front view of person wearing frontal strip style 1.
Figure 9:
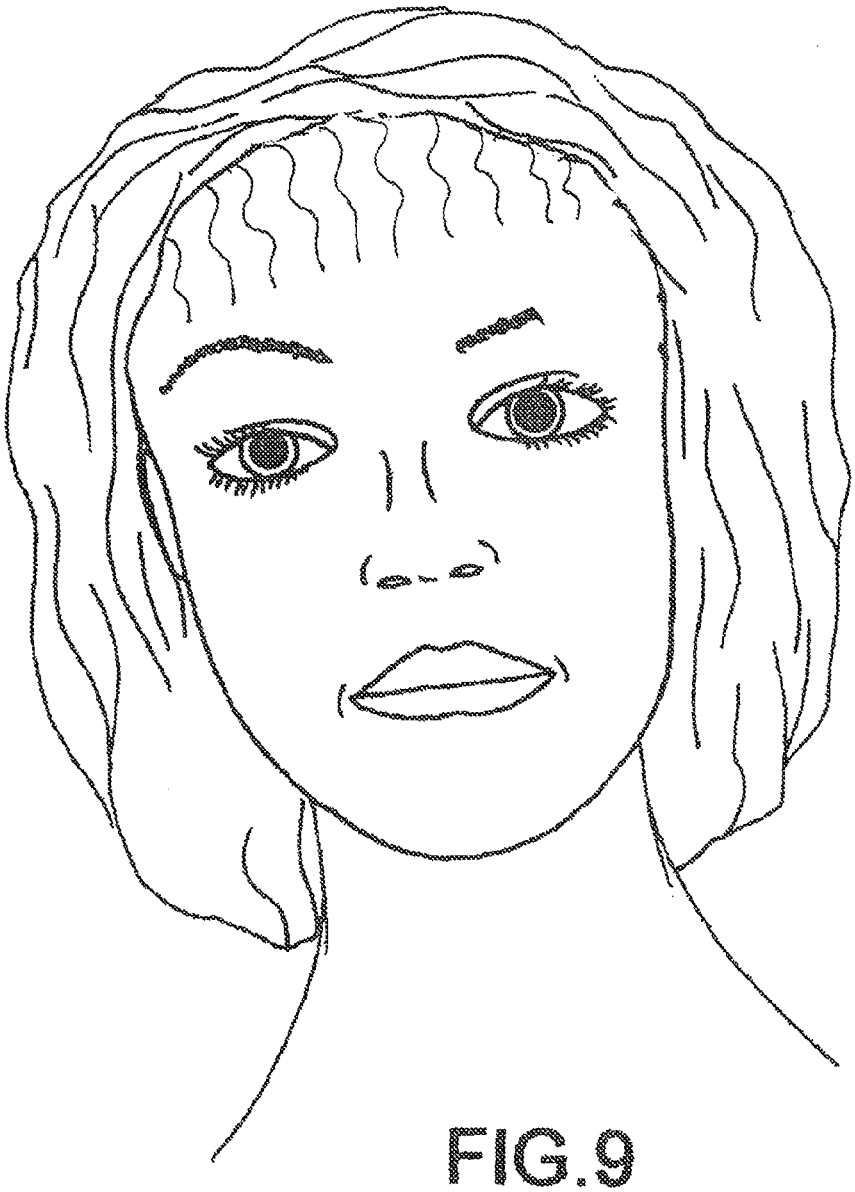
FIG. 9 is front view of person wearing frontal strip style 2.
Figure 10:
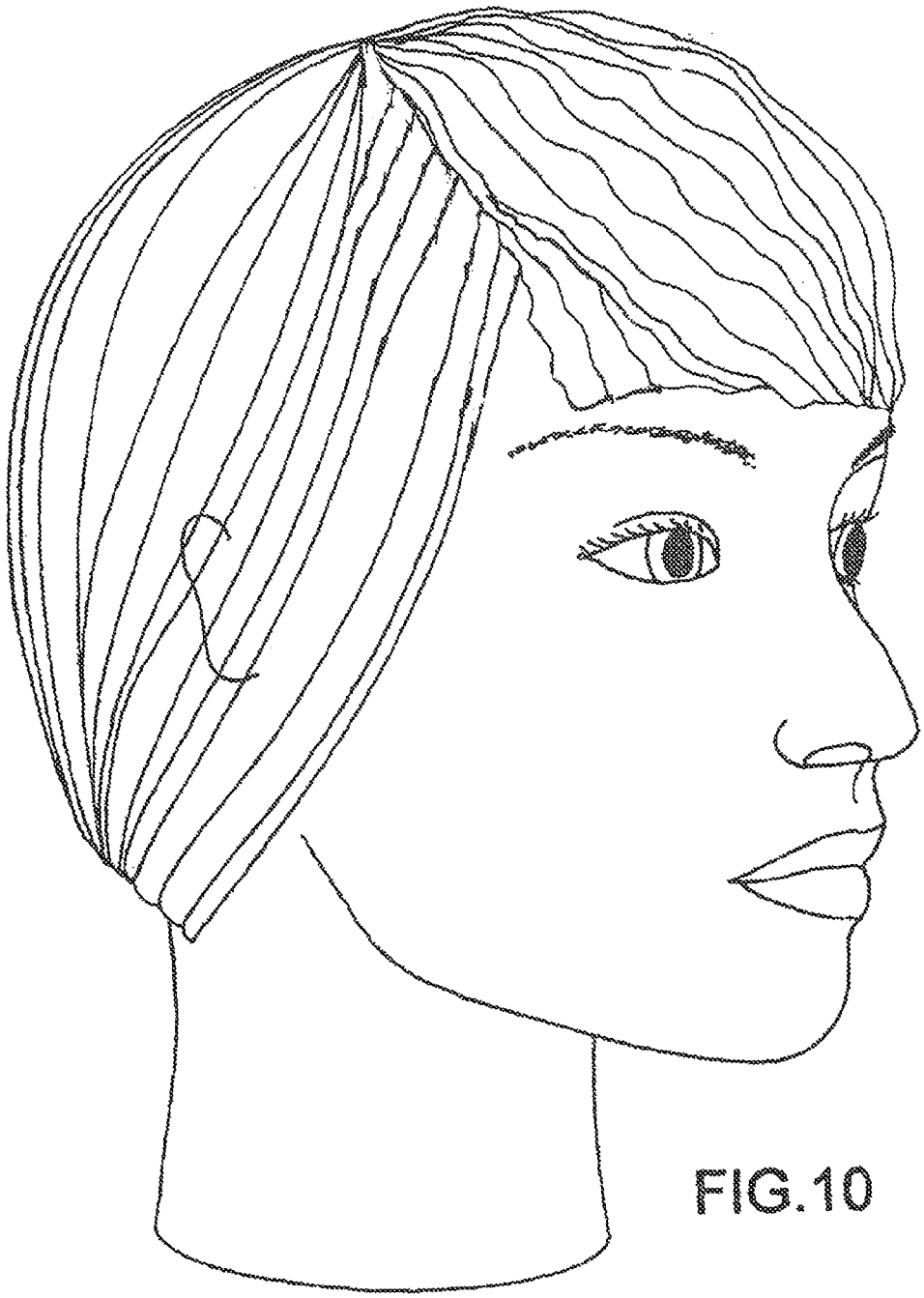
FIG. 10 is side view of person wearing frontal strip style 3.
Figure 11:
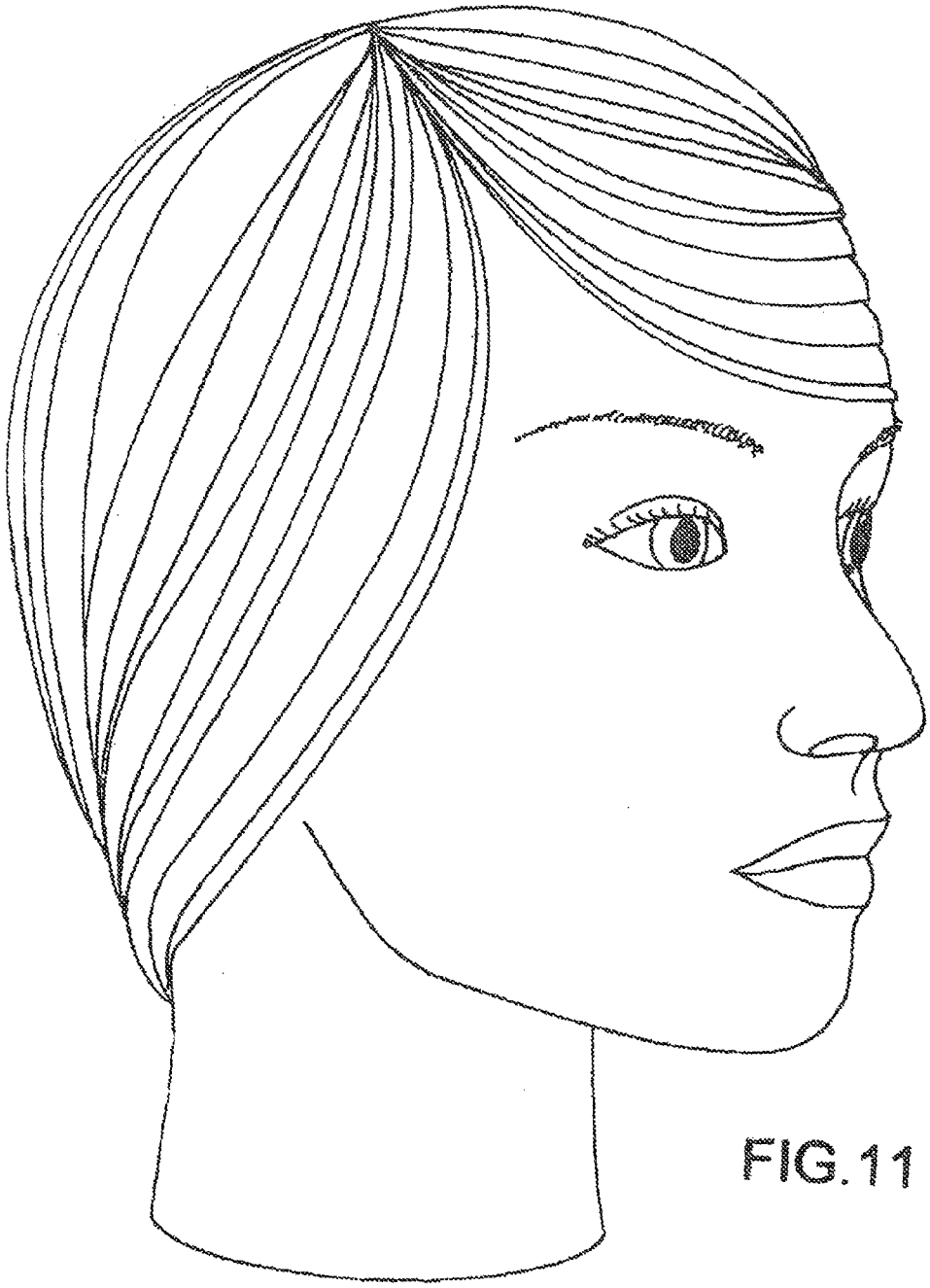
FIG. 11 is side view of person wearing frontal strip style 4.
Figure 12:
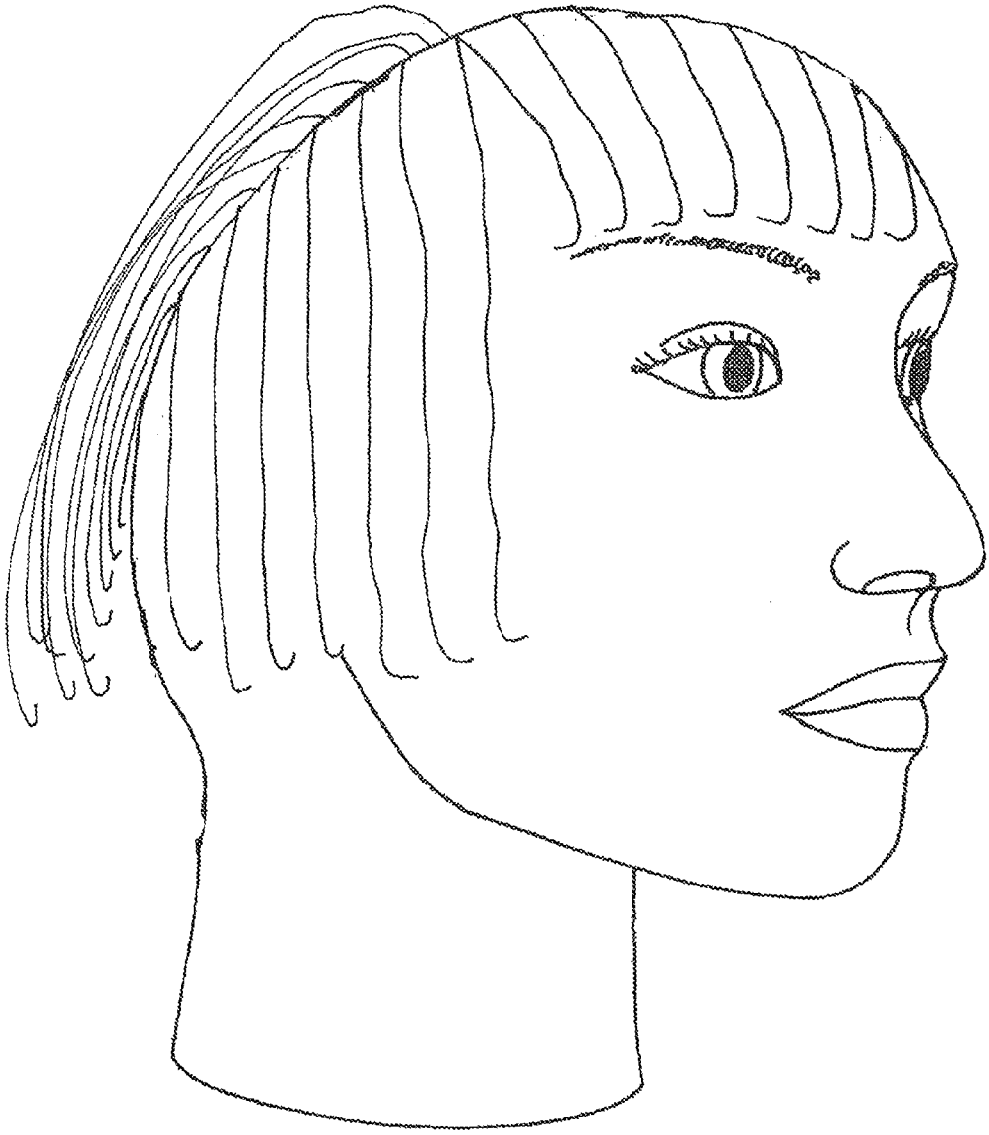
FIG. 12 is side view of person wearing frontal strip style 5.
Figure 13:
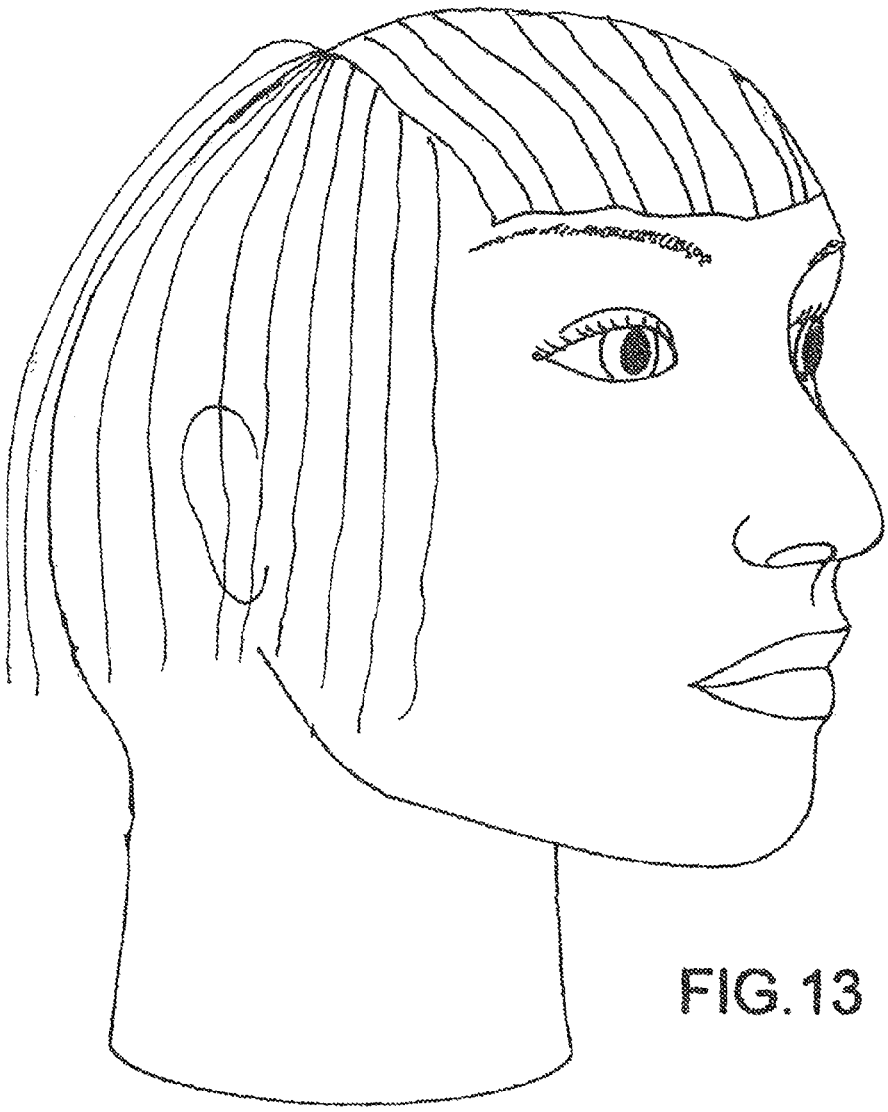
FIG. 13 is side view of person wearing frontal strip style 6.
Figure 14:
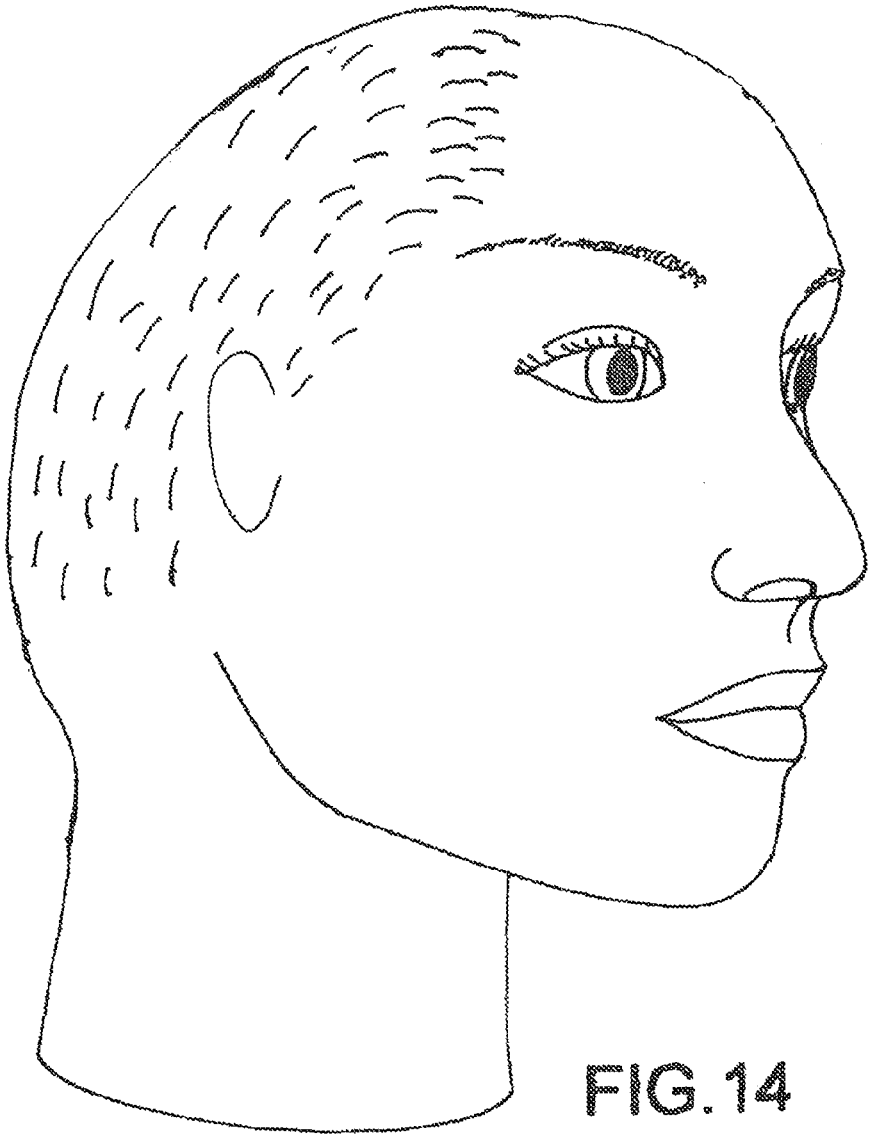
FIG. 14 is side view of person with a receding hair line and/or sparse hair.

The current invention comprises of hair strips with maybe attached strategically on a person's head to enhance their appearance. There is the frontal strip 2 which is intended to be adhered to the frontal portion of a person's scalp redefining the person's hair line. Additionally, hair strips can be clipped, sewed, weaved into said person's real hair.

In the preferred embodiment the woven net is limited to the outer edges of the supplemental hair component, whereas the rest is a synthetic resin or synthetic rubber structure produced through a compression or pressure process by a molding operation. This structure is a frame having no crumpling nor undesirable angles and, with it, it is possible to work out the standardizations and mass production of components or bases comprising rows of the framed strips and bridge connection forms, the spacing between the rows of strips and the bridge connection forms being readily accomplished In the preferred embodiment, a component base for a hair extension may comprise a net woven from silk or cotton yarn or synthetic fiber and such a net may be coated with a resin. It is also known that, to make a stretch net, the fiber may be covered with latex or spandex.

Said frontal edge or entire portion of the supplemental hair component base may be comprised out of a material such as a silk with similar color tone as the person's skin. Ideally, the materials utilized to form the frontal base are intended to be visually unnoticeable compared to the person's skin tone. The hair strands rooted to the frontal portion of the supplemental hair system must resemble a person's natural hair line. The base may be trimmed as a person desires their hair line.

Additionally, the frontal strip 2 of the supplemental hair system may be removed and replaced with an alternate frontal portion to form a new hair style. A person may desire bangs one week and no bangs the other.

In the preferred embodiment, the liner 7 is utilized to sustain most of the wear and tear. The liner 7 may be removably attached to the base with mechanical means 5 such as but not limited to clips, hooks, or fasteners. Alternatively, the liner 7 maybe attached with chemical means such as but not limited to glues and paste. The liner 7 is intended to be unnoticeable, which can be made from similar materials as the base. The liner is intended to absorb any moisture. Additionally, the liner 7 is intended to limit the wear of adhesives on the base. The person is to use common wig adhesive or any other method to secure the liner 7 to the head.

In the preferred embodiment, additional strips 3 or clumps of hair may be used in conjunction with the frontal strip 2 or independently to create a fuller looking head of hair. Said hair maybe clipped 5 or otherwise attached as known to person's skilled in the art. onto the person's head or weaved in. Additional components can be added as desired by the person. On purpose for the current invention is for people who are not entirely bold or do not want to wear a full wig. Said supplemental hair components may be added to enhance the person's natural hair.

The construction of attaching the hair to the base can be accomplished in any method that is known to persons skilled in the art.

In a preferred embodiment, the formation of a generally monolithic synthetic resinous or rubber component or base with which it is possible to change the hair style according to the user's pleasure, a semicircular component or base profiled to the human head comprises spaced rows of frame strips linked by bridge connection forms to form the spaces.

The perforated component manufactured in accordance with the above does not compress the user's own hair and provides for a good ventilation effect as well as hygienic cleanliness. Further, the new component permits removing perspiration and can be washed because the synthetic resinous or rubber component or base will maintain its original state, even in water, without any relaxation. The single process required to produce this new component or base provides for mass production techniques and reduces prices.

It is even possible to implant human or artificial hair in an optional direction onto this component or base by known methods. When a piercing transplantation or implanting of hair through the rows of the frame strips is effected, the resulting supplemental hair no thick belt-type weft as seen in machine-made wigs or in component less wigs. Furthermore, the new supplemental hair no binding knot as seen in hand-made wigs. Accordingly, this supplemental hair gives an appearance as if the hair were a growth of the user's own hair. Its structure makes it possible to change easily the direction of hair with a comb at the user's pleasure and to make optional hair styles which are impossible with known wigs such as machine-made wigs, component less wigs or hand-made wigs, or the like.

In the new supplemental hair, the rows of the frame strips can be changed to a whirl or spiral type. An elastic gum band B can be attached along the semicircular edge of this component or base or the edge can be cut at spaced positions to attach separate elastic bands onto it to enable adjusting the size of the extension.

The structure of this invention can also be utilized by those who are partially or completely bald. The supplemental hair is suitable for those whose forehead is bald.

In further accordance with this invention, the frame strips of the component or base can be replaced with a synthetic resin or rubber tube or belt-plate. Specifically, the human or artificial hair is transplanted directly onto the above-mentioned tubes or belt-plates and the tubes or belt-plates are sewed or otherwise attached onto the component or base or onto the laces for the component less type.

According to this invention, the human or artificial hair is transplanted directly by a single process onto the synthetic resin or synthetic rubber tube or belt-plate to form the hair strip group. The hair cannot fall out because it is transplanted tightly into the flexible synthetic resin or synthetic rubber tube or belt-plate.

Specifically, the hair strip group can also be stuck with adhesive agents or by heat-treatment onto or into the tube or belt-plate. The adherence can also be effected by high-frequency or supersonic wave treatment. In any event, a clean hair strip group can be obtained without the appearance of adherence.

After the formation of hair strip groups as mentioned above, the length of hair is cut to a length which can form any optional hair style and the hair strip groups are attached or sewed onto the associated component or base which conforms to the shape of a human head and in order to form optional hair styles.

The hair strip groups can also be attached with adhesive agents onto components or bases for wigs or onto laces for component less types. When the hair strip groups are attached by heat treatment onto components or bases or onto laces for the component less types, the hair strip groups can be attached without there appearing any vestige of adherence by the use of high-frequency or by the supersonic wave adhesive treatments.

Furthermore, if the hair is transplanted onto a tube to form the tube-type hair strip group which is hung onto the lace for the component less type, the direction of hair strip groups can be changed optionally at the user's pleasure because the hair strip groups hung on the hooks placed on the lace belt for the component less type can be moved to an optional direction.

As mentioned above, this invention is characterized in that the hair strip groups can be produced by a single machine process and thus the mass production of hair strip groups is possible by a single mechanical process. The resulting transplantation of hair is uniform and dense and the hair cannot fall out. The new extension constituted by the hair strip groups of this invention appears as if the hair were to be rooted actually on the human scalp. The direction of hair or the hair style is optional at the user's pleasure. The hair strip groups when hung on hooks can readily be moved or replaced. Change of color in whole or in part is also possible by the attachment or removal of specific hair strip groups which are hung on the hooks of the strip or lace.

While the above invention has been described with reference to certain preferred embodiments, the scope of the present invention is not limited to these embodiments. One skilled in the art may find variations of these preferred embodiments which, nevertheless, fall within the spirit of the present invention, whose scope is defined by the claims set forth below

I claim:

1. A hair extension comprising:

a net base having opposing top and bottom surfaces and a predetermined shape; a fastening device located on the bottom surface of the base and a plurality of supplemental hairs secured to the top surface of said base;

a mesh liner having opposing top and bottom surfaces and is substantially the same shape as the base; a fastening device located on the top surface of the liner configured to removably engage the fastening device of the base;

wherein the base and liner are connected via the fastening devices to be coextensive in shape during use.

2. The system of claim 1 where the liner is attached to the base via clips.

3. The system of claim 1 where the liner is attached to the base via a hook and loop fastener.

4. The system of claim 1 where the base is silk.

5. The system of claim 1 where the base is cotton yarn.

6. The system of claim 1 where the base is a synthetic fiber.

7. The system of claim 1 where the base is coated with resin.

8. The system of claim 1 where the base is a color to match the skin tone of the user.

9. A hair extension comprising:

a net base having opposing top and bottom surfaces and a predetermined shape; a fastening device located on the bottom surface of the base and a plurality of supplemental hairs secured to the top surface of said base; the net having a color to match the skin tone of the user and the base coated with a resin;

a mesh liner having opposing top and bottom surfaces and is substantially the same shape as the base; a fastening device located on the top surface of the liner configured to removably engage the fastener of the base; the mesh having a color to match the skin tone of the user;

wherein the base and liner are connected via the fastening devices to be coextensive in shape during use.

10. The system of claim 9 where the liner is attached to the base via clips.

* * * * *